United States Patent [19]

Vick et al.

[11] Patent Number: 4,528,901

[45] Date of Patent: Jul. 16, 1985

[54] MACHINE FOR PEELING CEREAL GRAINS BY MEANS OF RUBBER ROLLS

[75] Inventors: Walter Vick, Hamburg; Rolf Suhrbier, Norderstedt, both of Fed. Rep. of Germany

[73] Assignee: F. H. Schule GmbH, Hamburg, Fed. Rep. of Germany

[21] Appl. No.: 629,220

[22] Filed: Jul. 10, 1984

[30] Foreign Application Priority Data

Jul. 11, 1983 [DE] Fed. Rep. of Germany ... 8319935[U]

[51] Int. Cl.[3] ..... B02B 3/04; B02B 7/02

[52] U.S. Cl. ..... 99/488; 99/524; 99/609; 99/621; 241/34

[58] Field of Search ..... 99/486, 488, 489, 519, 99/523, 524, 600, 609–611, 617–622; 241/34, 37

[56] References Cited

U.S. PATENT DOCUMENTS

| | | | |
|---|---|---|---|
| 294,418 | 3/1884 | Wegmann | 241/37 X |
| 2,174,843 | 10/1939 | Roth | 241/37 |
| 3,857,333 | 12/1974 | Satake | 99/609 X |
| 4,295,614 | 10/1981 | Bond | 241/231 X |

FOREIGN PATENT DOCUMENTS

| | | | |
|---|---|---|---|
| 2065086 | 6/1981 | United Kingdom | 99/609 |

*Primary Examiner*—Timothy F. Simone
*Attorney, Agent, or Firm*—Handal & Morofsky

[57] ABSTRACT

Machine for peeling cereal grains, especially rice, by means of rubber rolls. Above the rolls (1,3) there is a bin (7) for the supply of material. An arrangement (13–18) is present, which cuts off the supply of material and/or separates the rubber peeling rolls, when a minimum loading (10) in the bin has been passed in the downward direction. The bin is mounted on springs (9) so as to be movable up and down, so that its position in the vertical direction is dependent on the degree of loading. The bin cooperates with a control (15) which is arranged fixed on the frame and which is changed over when the container reaches a high level because of its minimum loading, for separating the rolls (1,3) or for turning off the material supply. The control is again changed over when the bin has moved downwards again because of attaining a higher loading (11).

16 Claims, 1 Drawing Figure

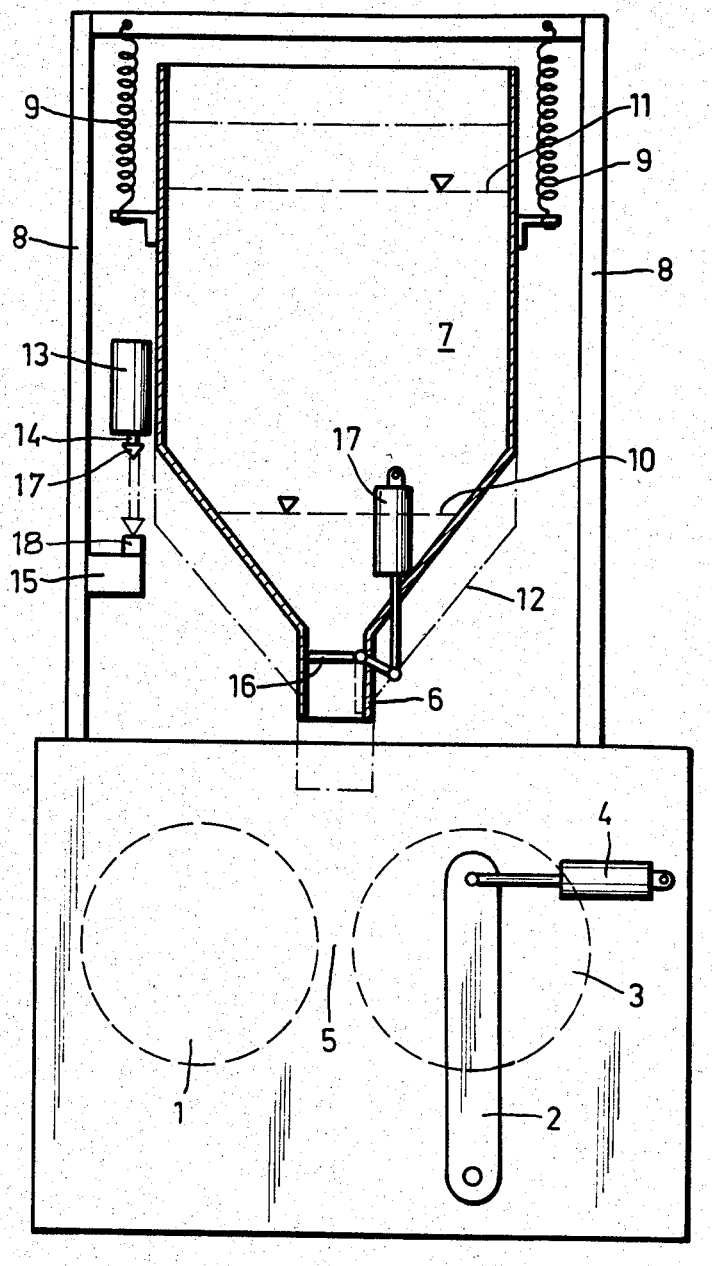
9
11
9
8
8
7
13
14
17
17
10
18
15
12
16
6
4
3
5
1
2

MACHINE FOR PEELING CEREAL GRAINS BY MEANS OF RUBBER ROLLS

The invention relates to a machine for peeling cereal grains by means of rubber peeling rolls, which has a bin for the material to be peeled, mounted to be movable up and down and supported by a resilient force, and a control arrangement for cutting off the supply of material, and/or for separating the rubber peeling rolls, in the event of reaching minimum loading in the bin, the control arrangement comprising a control and a control actuating member, of which one is fixed to the frame and the other is fixed to the bin, and which, in consequence of approach or separation in space of their cooperating components, cooperate in such a way that the control is changed over into one condition when the bin reaches a predetermined upper position, and maintains that condition until the bin reaches a predetermined lower position, at which the control is changed over into another condition, and maintains this until the bin again reaches the upper position.

In rubber roll peelers, the peeling operation depends on the fact that the material to be peeled is fed through a roll gap which is formed between two rolls rotating at different speeds, the surface of which is covered with rubber. If the supply of material fails, the rubber surfaces rub on one another and heat up, which can lead to damage. Known rubber roll peelers (U.S. Pat. No. 4,295,614) therefore have a pneumatic loading measurer within a bin for the material to be peeled, provided before the roll gap; on passing below a minimum loading, the measurer causes closure of the bin outlet leading from the bin to the roll gap, and separation of the peeling rolls. So long as such an arrangement works, it protects the machine upon failure of the supply of material. However, the loading measurer of the known machine depends on a delicate pneumatic control movement and is not reliable enough in the rough operation, to which such machines are subjected in the countries which are of principal concern as rice producers.

The control arrangement mentioned at the beginning is known (German OS No. 1,517,840; German Pat. No. 510,768) in milling plants of another kind, and it appears in principle to be usable also in rubber roll peelers. However, with the known control arrangement, there is no way of telling how to obtain the result that the one condition of the control will be maintained throughout emptying of the bin, until its minimum loading is reached, and the other condition during the filling of the bin. Possibly a bistable control is used. The reliability of such controls under rough operating conditions sometimes leaves something to be desired, especially with pneumatic controls.

In one rubber roll peeler it is also known (U.S. Pat. No. 3,857,333) to avoid an overflow of the separator, which serves to separate the peeled and the non-peeled material after passing through the peeling rolls, by arranging that the material to be separated flows through a bin supported on springs, the position of the bin in the vertical direction being transmitted by a linkage to a slide valve, which regulates the supply of fresh material to be peeled. Thus the supply of material is adjusted progressively in dependence on the loading in the bin. There is no arrangement provided for protection of the rubber rolls, such as was described above. Moreover there is no provision of on/off control, which would be necessary for an arrangement for protection of the rubber roll peeler.

Thus the object underlying the invention is to provide a machine of the kind mentioned at the beginning, which is reliably protected from damage by failure of the supply of material.

The solution according to the invention lies in the fact that one of the two components of the control arrangement (control or control actuating member) is connected with its cooperating member via an adjusting member which can be actuated by means of a motor, and which can assume two positions, the associated cooperating member in one position being so far separated from the other cooperating member that these cooperate only at one of the two predetermined positions of the bin in the vertical direction, while in the other position of the adjusting member the associated cooperating member cooperates continuously with the other cooperating member, except at the other position of the bin.

Thanks to the motorised adjustment of the adjusting member, it is certain that one condition of the control always exists when the bin is in transition from full to empty, and then the other condition of the control prevails when the empty condition is reached, until maximum loading has occurred again. The result of this is a forced control, which can be put into effect with simple means, and hence is very reliable. Furthermore, the functioning is easy to oversee, even for technically inexperienced people, so that appropriate maintenance or adjustment is easily achieved, even in those countries in which one cannot necessarily expect that skilled technicians are available. Moreover the control itself can easily be very robustly constructed, having regard to the large forces which are available for changing it over. This is particularly so, if it is constituted by a pneumatic control, and the operations to be controlled by it are also carried out by pneumatic motors.

Preferably the motor is constituted by an expansion motor, which is actuated by pressure fluid when the control is in one condition, and is returned by a resilient force when the control is in its other condition. Preferably the control actuating member includes a piston-and-cylinder arrangement as the expansion motor, and the adjusting member is constituted by the piston rod, which at one end carries an abutment serving as a cooperating member. In the 'off' condition of the control, the piston rod is urged to one end position by spring force or gravity; then the abutment only reaches the control when at least the predetermined upper loading is present in the bin; after the changeover of the control to 'on' which is caused by this loading condition, the piston rod is urged to the other end position, in which it changes over the control to 'off' when the minimum loading in the bin is attained. Thus a pneumatic cylinder can, for example, be secured perpendicularly onto the bin, above the stationarily installed control. In the 'off' condition, when the bin is lifted because the loading is too small, the piston rod is withdrawn into the cylinder by spring force, and its end then hangs above the control at a distance which is not indeed equal to, but is proportional to, the difference in position in the vertical direction between the minimum loading and the higher loading, and thus corresponds to it. If the bin is filled, it gradually sinks until, when the higher loading is reached in the bin, the end of the piston rod reaches a movable member of the control, which is adapted to be depressed by external means, and changes the control to 'on'. The changeover of the control to 'on' not only causes opening of the bin outlet opening, and the moving together of the peeling rolls, but also causes actuation of the pneumatic cylinder with air pressure, so that the rod is urged downwards against the spring force. The end of the piston rod thus has a lower effective position, or presses effectively on the control. When the bin rises again because of failure of the supply of material, then the end of the piston rod loses its effect on the control just when the bin has risen by the same travel as equals the outward stroke of the piston rod.

The components which were referred to further above as cooperating members are, in this example, constituted by the lower end of the piston rod on the one hand, and by the depressible member of the control on the other hand.

The invention will be explained in more detail below, with reference to the drawing, which shows an advantageous embodiment in very schematic side view.

The rubber roll peeler includes a peeling roll 1 mounted in fixed position in the housing, and a peeling roll 3 mounted pivotally on a rocker 2 to be movable roughly horizontally, towards the roll 1 and away from it. The rocker 2 is movable by means of a pneumatic cylinder 4. Thus the actuation of the cylinder 4 can serve for production of the necessary peeling force in the roll gap on the one hand, and for separation of the peeling rolls on the other hand.

A bin 7 is arranged above the machine, and has an outlet 6 which opens above the roll gap 5. This bin is suspended in a frame 8 on springs 9, so that its position at any time in the vertical direction is dependent on its loading. With minimum loading 10, it assumes the particular position shown by solid lines. With a higher loading 11 it has a lower position shown in chain lines at 12.

On the side wall of the bin 7 is secured a pneumatic piston-and-cylinder device 13, the piston rod 14 of which emerges vertically downwards, and carries an abutment head 17 at the end. In line with the piston rod, and below the latter, a control 15 is fixed to the frame 8. From this control there projects a member 18 which is adapted to be depressed against spring force, for actuation of the control. The abutment head 17 and the depressible member constitute the above-mentioned cooperating members. The piston rod 14 constitutes the adjusting member, and the piston-and-cylinder device 13 constitutes the motor for the adjusting member. The piston-and-cylinder device with the piston rod and the abutment head is the control actuating member and, together with the control, constitutes the control arrangement.

In the outlet 6 of the bin there is a valve 16, which can be opened and closed by means of the piston-and-cylinder device 17.

When, with minimum loading 10, the bin 7 is in the raised position, the control 15 is in 'off' condition, because the piston rod 14 is withdrawn into the cylinder by spring force, and its abutment head 17 has thus lost operating connection with the member 18 of the control 15. Because the control 15 is in the 'off' condition, the cylinders 4 and 17 are subjected to air pressure in a direction predetermined for 'empty', and hence the disc valve 16 is closed and the rolls 1 and 3 are separated.

If the bin 7 is filled to the upper loading 11, it sinks into the position shown in chain lines, in which the end of the piston rod 14 also reaches the position in chain lines, and thus changes the control 15 to 'on'. The result of this is that, firstly the valve 16 opens, secondly the rolls 1 and 3 are brought together and thus the peeling operation is resumed, and thirdly the cylinder 13 is subjected to air pressure, so that the piston rod 14 remains urged downwards, even if the bin then gradually rises because of progressive emptying. It is only when the minimum loading 10 and the position of the bin shown in full lines are again reached, that the head 17 of the piston rod 14 loses its connection with the control 15, and that hence the latter is again changed to 'off'.

We claim:

1. A machine for peeling cereal grains, comprising:

(a) first and second peeling rolls for peeling said cereal grains, said first peeling roll being fixedly mounted and positioned adjacent to said second peeling roll, said second peeling roll being moveably mounted to separate from and to form a gap with said first peeling roll;

(b) a bin for containing a supply of said cereal grain having first and second opposing end walls, one of said end walls defining an accepting orifice for cereal grain and said other end wall defining a delivering orifice for cereal grains, said delivering orifice being positioned to directly deliver said cereal grain to said first and second peeling rolls, said bin being mounted to move along an axis substantially normal to the earth's surface;

(c) a machine frame;

(d) resilient means, fastened to said bin at one end and to said machine frame at another end, for providing a resilient force to said bin, said resilient force having a direction substantially parallel to said axis of said bin movement, said resilient means being calibrated to sustain said bin in an upper position along said axis of movement when said grain supply is at a minimum loading, said resilient means permitting said bin to be gradually displaced for many displacement positions depending upon the change in said grain supply that exceeds said minimum loading;

(e) control means for controlling said machine; and (f) activating means coupled between said bin and said machine frame for initiating said control means, said activating means comprising a control actuating member having a motor, an adjusting member, and a first cooperating member, said activating means further comprising a control device having a second cooperating member and a control, said control actuating member being fixed in a position to cooperate with said control device by mutual contact of said first and second cooperating members, said cooperation changes said control from a first condition to a second condition, the mutual contact between said first and second cooperating members being initally realized when said bin is at a maximum displacement position along said axis of movement and said adjusting member is in a retracted position, the mutual contact of said first and second cooperating members being maintained by an urging force generated by said motor and delivered by said adjusting member as said bin is being displaced toward said upper position, said first condition of said control being resumed by the separation of said first and second cooperating members at a moment when said bin attains said upper position.

2. A machine for peeling cereal grains as claimed in claim 1, wherein said motor is constituted by an expansion motor, said expansion motor being actuated by a pressure fluid causing said adjusting member to extend from said retracted position away from said expansion motor when said control is in said second condition, said adjusting member being returned from an extended position to said retracted position by a resilient force when said control is in said first condition.

3. A machine for peeling cereal grains as claimed in claim 2, wherein said control actuating member comprises a piston-and-cylinder arrangement, said piston-and-cylinder arrangement comprising a cylinder and a piston, said adjusting member comprising a piston rod that is attached at one end to said piston and to an abutment head at the other end, said abutment head serving as said first cooperating member, said control being in said first condition when said piston rod is returned by a spring force to said retracted position, said abutment head initially contacting said second cooperating member of said control device when said piston rod is in said retracted position, said control being changed to said second condition at the momemt of intitial contact of said abutment head and said second cooperating member, said piston rod then being urged to said extended position as said bin approaches said upper position, said control being changed to said first condition when said bin attains said upper position and when said piston rod has attained said extended position.

4. A machine for peeling cereal grains as claimed in claim 3, wherein said piston rod is actuated pneumatically and said control is a pneumatic control.

5. A machine for peeling cereal grains as claimed in claim 1, wherein said control means is employed for controlling the delivery of said cereal grain to said first and second peeling rolls at a moment when said supply of cereal grain contained in said bin diminishes to said minimum loading.

6. A machine for peeling cereal grains as claimed in claim 1, wherein said control means is employed for separating said first and second peeling rolls at a momemt when said supply of cereal grain contained in said bin diminishes to said mininum loading.

7. A machine for peeling cereal grains as claimed in claim 1, wherein said control means is employed for both controlling the delivery of said cereal grain to said first and second peeling rolls and for separating said first and second peeling rolls at a moment when said supply of cereal grain contained in said bin diminishes to said minimum loading.

8. A machine for peeling cereal grains as claimed in claim 1, wherein said control actuating member is fixed to the exterior surface of a sidewall of said bin, and said control device is fixed to said machine frame.

9. A machine for peeling cereal grains as claimed in claim 1, wherein said control actuating member is fixed to said machine frame, and said control device is fixed to the exterior surface of a sidewall of said bin.

10. A machine for peeling cereal grains as claimed in claim 7, wherein said motor is constituted by an expansion motor, said expansion motor being actuated by a pressure fluid causing said adjusting member to extend from said retracted position away from said expansion motor when said control is in said second condition, said adjusting member being returned from an extended position to said retracted position by a resilient force when said control is in said first condition.

11. A machine for peeling cereal grains as claimed in claim 7, wherein said control actuating member is fixed to the exterior surface of a sidewall of said bin, and said control device is fixed to a machine frame.

12. A machine as claimed in claim 11, wherein said control actuating member comprises a piston-and-cylinder arrangement, said piston-and-cylinder arrangement comprising a cylinder and a piston, said adjusting member comprising a piston rod that is attached at one end to said piston and to an abutment head at the other end, said abutment head serving as said first cooperating member, said control being in said first condition when said piston rod is returned by a force to said retracted position, said abutment head initially contacting said second cooperating member of said control device when said piston rod is in said retracted position, said control being changed to said second condition at the moment of initial contact of said abutment head and said second cooperating member, said piston rod then being urged to an extended position as said bin approaches said upper position, said control being changed to said first condition when said bin attains said upper position and when said piston rod has attained said extended position.

13. A machine for peeling cereal grains as claimed in claim 12, wherein said force is a spring force.

14. A machine for peeling cereal grains as claimed in claim 7, wherein said control actuating member is fixed to said machine frame, and said control device is fixed to the exterior surface of a sidewall of said bin.

15. A machine for peeling cereal grains as claimed in claim 14, wherein said control actuating member comprises a piston-and-cylinder arrangement having a cylinder and a piston, said adjusting member comprising a piston rod that is attached at one end to said piston and to an abutment head at the other end, said abutment head serving as said first cooperating member, said control being in said first condition when said piston rod is returned by a force to said retracted position, said abutment head initially contacting said second cooperating member of said control device when said piston rod is in said retracted position, said control being changed to said second condition at the moment of initial contact of said abutment head with said second cooperating member, said piston rod being urged to an extended position as said bin approaches said upper position, said control being changed to said first condition when said bin attains said upper position and when said piston rod has attained said extended position.

16. A machine for peeling cereal grains as claimed in claim 15, wherein said force is a gravitational force.

* * * * *